US007044316B1

(12) United States Patent
Hsu

(10) Patent No.: US 7,044,316 B1
(45) Date of Patent: May 16, 2006

(54) STRAW SET WITH A VENTILATING STRUCTURE

(75) Inventor: William Hsu, Taipei (TW)

(73) Assignee: Tung Ling Industrial Co., LTD, Taipei (TW)

( * ) Notice: Subject to any disclaimer, the term of this patent is extended or adjusted under 35 U.S.C. 154(b) by 246 days.

(21) Appl. No.: 10/697,145

(22) Filed: Oct. 28, 2003

(51) Int. Cl.
*A61J 11/02* (2006.01)

(52) U.S. Cl. ..... 215/11.1; 215/11.5; 215/388; 220/367.1; 220/705; 220/714

(58) Field of Classification Search ..... 215/11.1, 215/11.4, 388, 11.5, 307, 386; 220/705, 220/714, 706, 367.1, 373, 374
See application file for complete search history.

(56) References Cited

U.S. PATENT DOCUMENTS 2,623,524 A * 12/1952 Clemens ..... 215/11.4
2,753,067 A * 7/1956 Rodriguez ..... 215/11.1
2,767,871 A * 10/1956 Shapiro ..... 215/11.5
2,968,414 A * 1/1961 Thomas ..... 215/11.1
3,059,797 A * 10/1962 Wilkinson et al. ..... 215/11.1
4,940,152 A * 7/1990 Lin ..... 215/11.5
5,211,298 A * 5/1993 Bloch ..... 215/11.1
5,284,261 A * 2/1994 Zambuto ..... 215/11.5
6,068,147 A * 5/2000 Sheu ..... 215/11.5
6,290,090 B1 * 9/2001 Essebaggers ..... 220/710
2001/0027956 A1 * 10/2001 Bonacorso et al. ..... 215/11.1
2003/0183595 A1 * 10/2003 Huang ..... 215/11.5
2004/0089626 A1 * 5/2004 Pyun ..... 215/11.5

FOREIGN PATENT DOCUMENTS

GB 2190596 A * 11/1987

* cited by examiner

*Primary Examiner*—Sue A. Weaver

(57) ABSTRACT

A straw set with a ventilating structure includes a nipple connected to a circular base with a circular air guiding trench, an air hole that passes through, and a chamber with two axles attached underneath. Underneath, a straw base consists of an inner circular wall fixed to the nipple, an outer circular wall fixed to the bottom of the circular base, another circular air guiding trench concaved between the inner and the outer circular walls, and a hollow pipe protruding downwards. The straw base is supported by a soft plastic circular base with a hole at the center, a second outer circular wall expanded upward to fix upon the first outer circular wall, a air guiding trench expanded downward from the edge of the second outer circular wall, and another air hole that passes through the soft plastic circular base.

1 Claim, 4 Drawing Sheets

STRAW SET WITH A VENTILATING STRUCTURE

FIELD OF THE INVENTION

The present invention relates to a straw set, and more particularly to a straw set having a ventilating structure thereon to balance the inner pressure and outer pressure of a baby bottle to sustain a nipple in an upward position.

BACKGROUND OF THE INVENTION

Due to the modern improvements of infant nutritional evaporated milk, an infant not only needs to be breast-fed, but also needs the infant nutritional evaporated milk to assist in the infant's growth. The common way of using evaporated milk is through bottle-feeding, i.e. place proper quantity of evaporated milk into a bottle with warm water, insert a nipple into a sealing-ring, and seal the sealing-ring to an opening of the bottle. When one shakes the bottle, the evaporated milk dissolves in warm water, and becomes ready for an infant to suck milk through a drawing hole on the nipple. Because the nipple covers the opening of the bottle, the only path to the inside of the bottle is through the drawing hole. When an infant sucks milk, the air inside the bottle is also being drawn out. Consequently, the air pressure in the bottle decreases. When the outer air pressure becomes much greater than the pressure in the bottle, the inner pressure is no longer sufficient to keep the nipple standing upwards for the infant to suck continuously. The infant has to repeatedly open his/her mouth to allow outer air to come in the bottle through the drawing hole in order to keep the air pressure inside the bottle high in order to suck out more milk. The above processes must be repeated until the infant finishes all the milk. Such interruptions are distracting to the infant and inconvenient for adults, who have to give the infant a constant hand in feeding.

SUMMARY OF THE INVENTION

A primary object of the present invention is to provide a straw set with a ventilating structure, which guides the air outside the bottle to the inside and maintains the air pressure inside the bottle as equal to the one outside to keep a nipple from flattening.

Another object of the present invention is to provide a nipple with a an air-guiding structure, which has a circular air guiding trench to guide outer air through an air-hole to the inside of the bottle to balance the air pressure outside and the pressure inside.

Still another object of the present invention is to provide a straw base with an outer circular wall, an inner circular wall, and a hollow pipe, whereupon a nipple is placed on the outer circular wall and sealed by the inner circular wall to make milk flow through the hollow pipe into the nipple to let an infant suck.

Still another object of the present invention is to provide a soft plastic circular base with a hole, an air guiding trench, and an air hole, and which fixes on the straw base to prevent milk from leakage, so that the outer air is guided into the bottle through the air guiding trench and the air hole equalizes the air pressure outside to the one inside.

Still another object of the present invention is to provide a soft straw with a head, which can touch any milk in the bottle.

To achieve the above objects, a straw set with a ventilating structure includes a nipple with a sucking part and a drawing hole that is connected to a circular base with a first circular air guiding trench, a first air hole that passes through, the circular base, and a chamber with two expanding axles attached underneath the circular base. Below the circular base, the straw base has an inner circular wall fixed to the bottom of the nipple, a first outer circular wall fixed to the bottom of the circular base, a second circular air guiding trench concaved between the inner and the outer circular walls, and a hollow pipe protruding downwards. The straw base is supported below by a soft plastic circular base with a hole at the center, a second outer circular wall expanded upward from the edge of the soft plastic circular base to fix upon the first outer circular wall, another air guiding trench expanded downward from the edge of the second outer circular wall, a second air hole located at the bottom side of the air guiding trench that passes through the soft plastic circular base.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
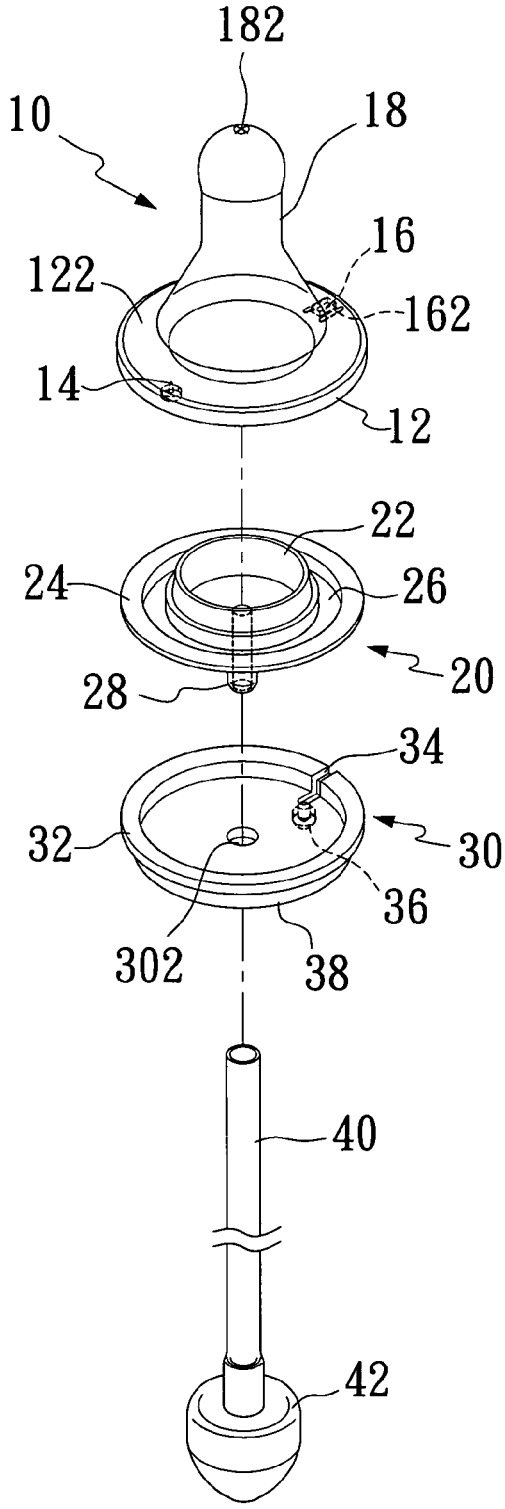
FIG. 1 is an exploded perspective view of a straw set with a ventilating structure according to the present invention.

Referring to FIG. 1, an exploded perspective view of the present invention is illustrated. A straw set with a ventilating structure is mainly assembled by a nipple 10, a straw base 20, a soft plastic circular base 30, and a soft straw 40. The nipple 10 is primarily divided into a circular base 12 and a sucking part 18 with a drawing hole 182; the straw base 20 is primarily divided into an inner circular wall 22, a first outer circular wall 24, a second circular air guiding trench 26, and a hollow pipe 28; the soft plastic circular base 30 is primarily divided into a hole 302, a second outer circular wall 32, an air guiding trench 34, a second air hole 36, and the bottom 38 of the soft plastic circular base; the soft straw 40 further includes a head 42.

The circular base 12 includes a first circular air guiding trench 122, a first air hole 14, and a chamber 16. The first circular air guiding trench 122 is posited on the upper surface of the circular base 12. The first air hole 14 passes through the circular base 12. The chamber 16 located on the bottom of the circular base 12 has two expanding axles 162. The sucking part 18 is connected with the circular base 12, and a drawing hole 182 is located at the center of the sucking part 18.

The inner circular wall 22 is located on the straw base 20. The first outer circular wall 24 is located at the edge of the straw base 20. The hollow pipe 28 is located at the center of the straw base 20. The second circular air guiding trench 26 is concaved between the inner circular wall 22 and the first outer circular wall 24.

The hole 302 is at the center of the soft plastic circular base 30. The second outer circular wall 32 is located at the edge of the soft plastic circular base 30. The air guiding trench 34 expands downward from the edge of the second outer circular wall 32 to the bottom 38 of the soft plastic circular base 30. The second air hole 36 is located at the bottom side of the air guiding trench 34.

Figure 2:
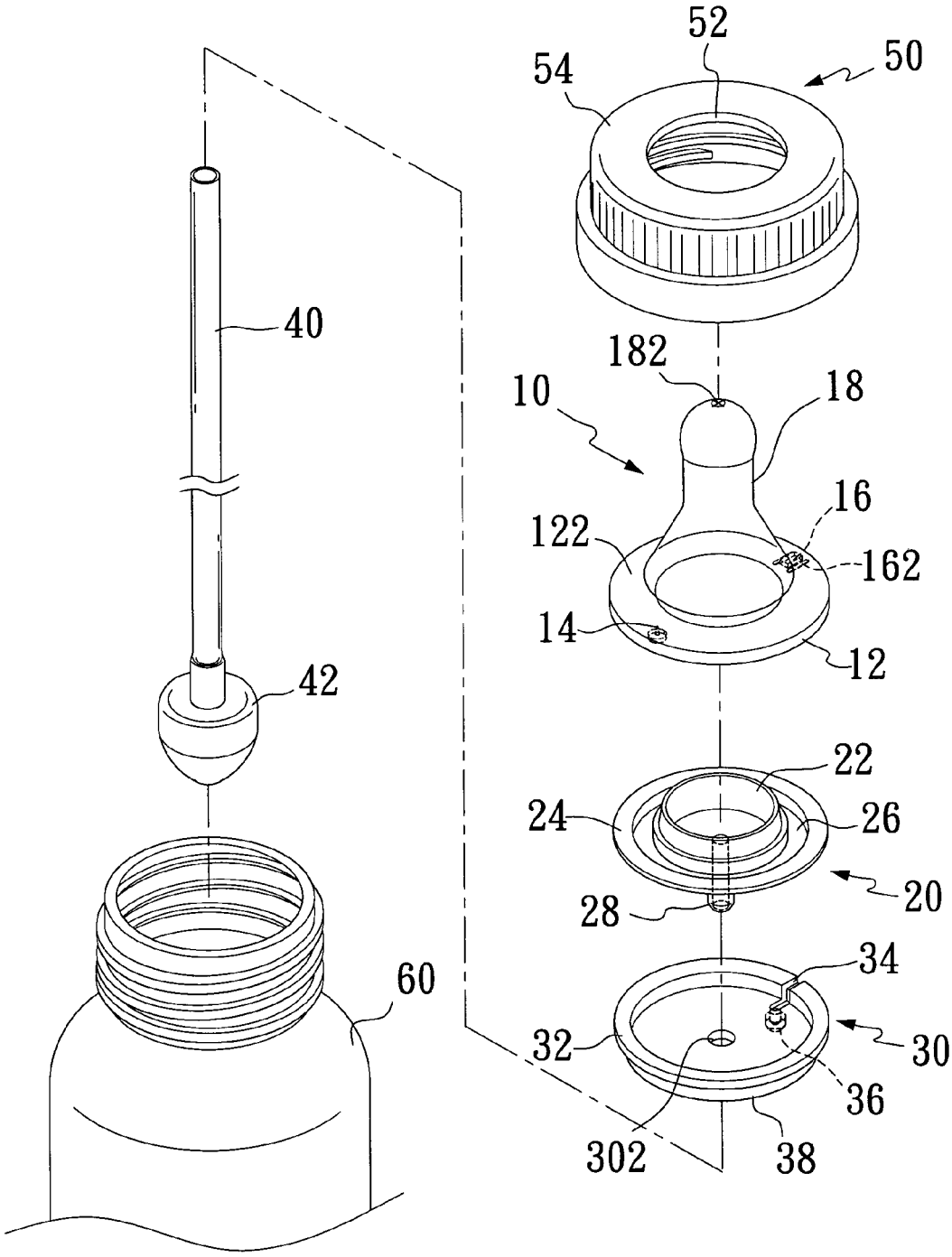
FIG. 2 is another exploded perspective view of a straw set with a ventilating structure of FIG. 1.
Figure 3:
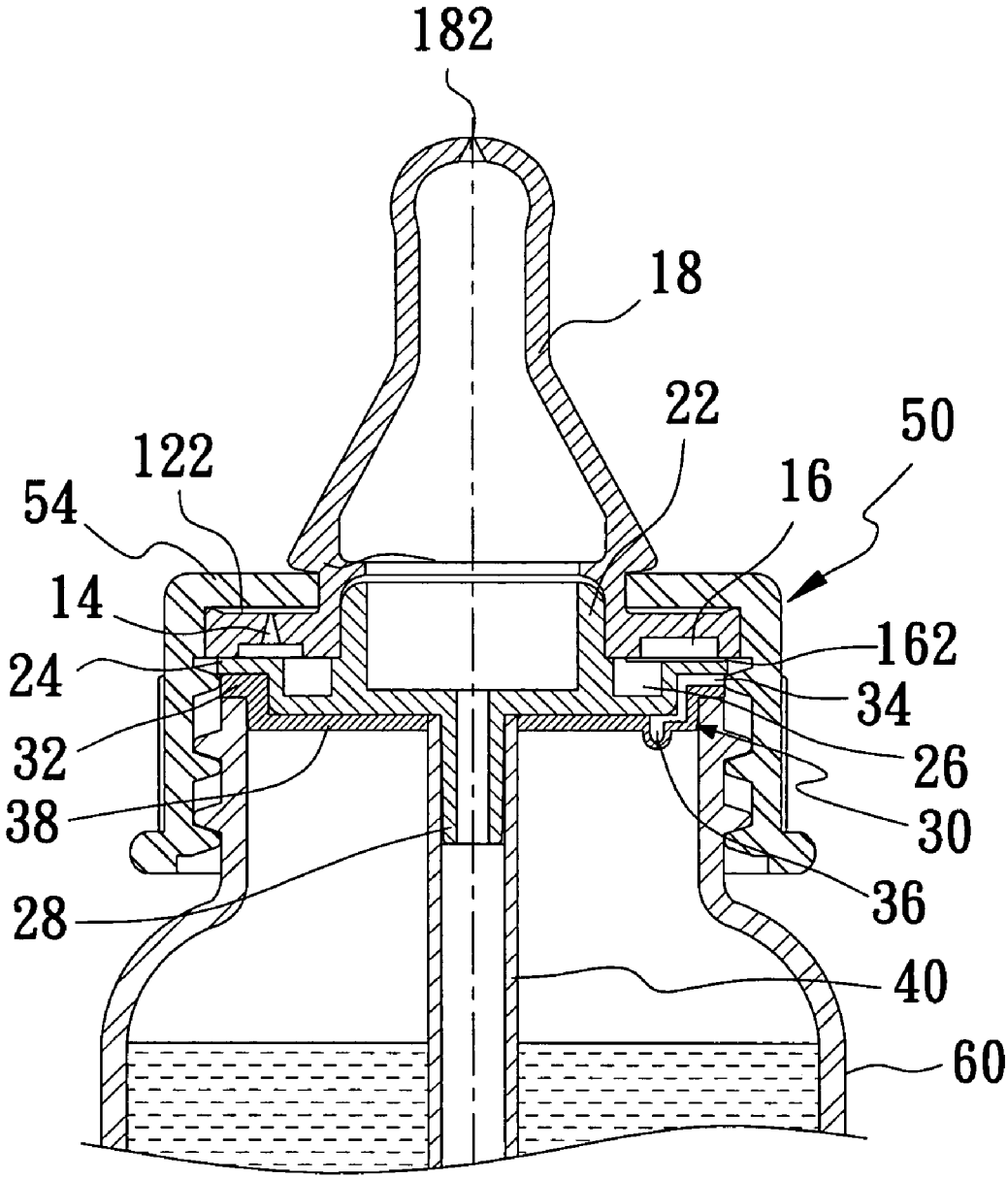
FIG. 3 is an assembled cross-sectional view of the straw set with a ventilating structure of FIG. 1.
Figure 4:
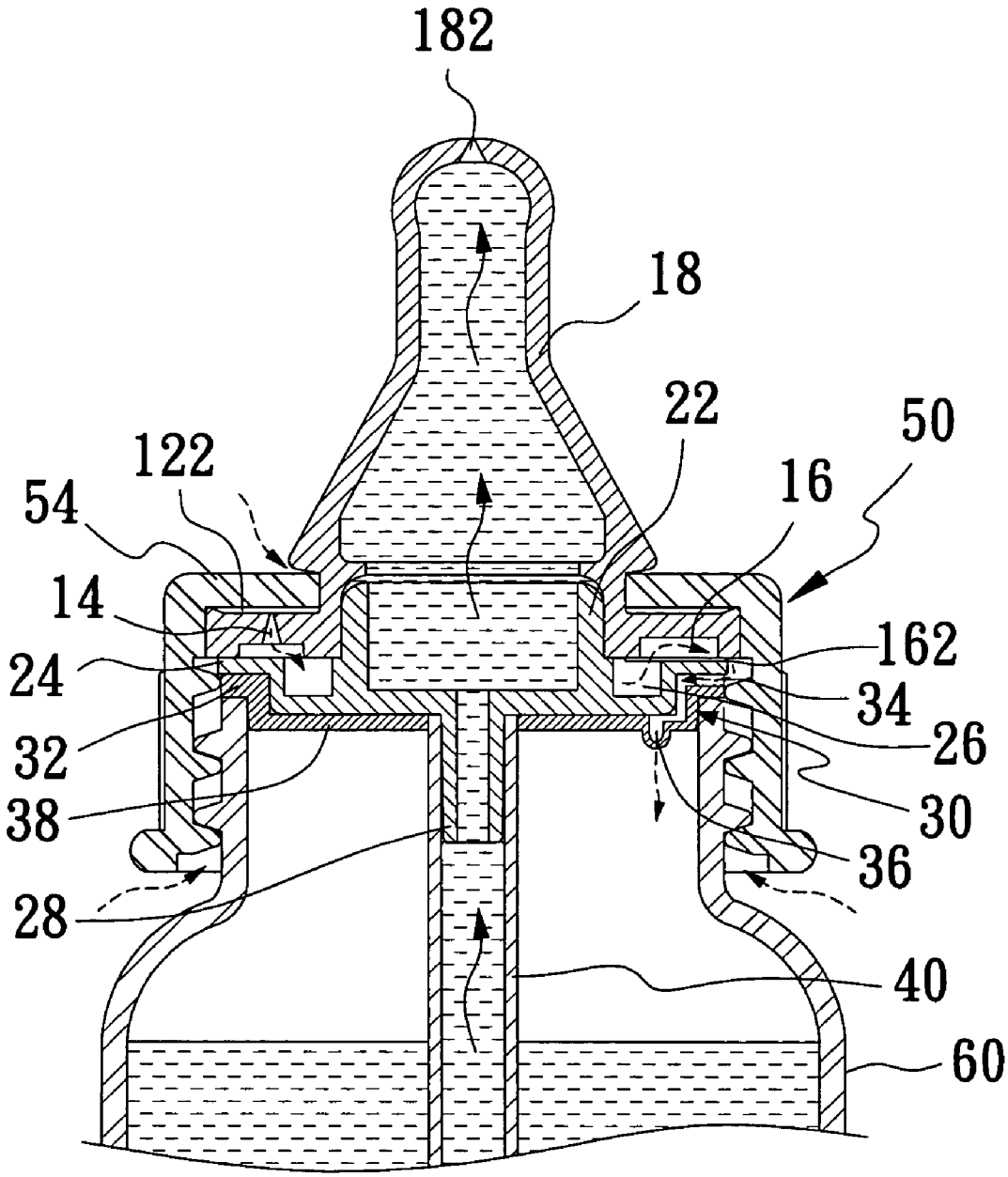
FIG. 4 is a cross-sectional view of an embodiment of FIG. 1.

FIG. 2 is the illustration of another exploded perspective view of the present invention. The sucking part 18 of the nipple 10 is placed into the sealing ring 50 with an opening 52, and the circular base 12 supports the bottom of the cover 54. The straw base 20 attaches to the nipple 10; the inner circular wall 22 supports the bottom of the sucking part 18 of nipple 10; the first outer circular wall 24 attaches to the base 12; the bottom of the first air hole 14 and the expanding axles 162 are partly displaced over the first outer circular wall 24 and partly displaced over the second circular air guiding trench 26. Air enters from the first air hole 14 to the chamber 16 through the second circular air guiding trench 26. The hollow pipe 28 passes through the hole 302 of the soft plastic circular base 30 and the soft plastic circular base 30 attaches to the bottom surface of the straw base 20. The soft straw 40 encloses the hollow pipe 28. Rotating the assembled straw set then fixes it to the opening of the bottle 60. Because the soft plastic circular base 30 attaches tightly to the bottle opening, milk will not flow out from the bottle opening. FIGS. 3 and 4 illustrate the assembled cross-sectional views of the present invention, with FIG. 4 also illustrating the air flowing path.

When an infant sucks milk from the drawing hole 182, the milk flows through the soft straw 40 and the sucking part 18, outer air flows into the first circular air guiding trench 122 through the space between the nipple 10 and the cover 54. This is illustrated by the broken arrows in FIG. 4. The outer air is then guided by the first circular air guiding trench 122 into the first air hole 14 before it flows through the second circular air guiding trench 26 into the chamber 16. Through the channel formed by the expanding axles 162, air flows into the air guiding trench 34, then flows into the bottle 60 through the second air hole 36 to maintain the air pressure in the bottle to a level which can sustain a nipple in an upward position by a sucking force. Adults needn't pull the nipple 10 out of the infant's mouth for such air movement to occur. Furthermore, due to the design of the soft plastic circular base 30 being closed tightly to the bottle opening, milk will not flow out under the bottle inversion. Due to the design of soft straw 40 with a head 42, a an infant can still suck milk under the bottle inversion, thus preventing milk residual.

Therefore, the present invention takes advantage of the design of the air hole and the air guiding trench to equalize the air pressures inside the bottle and outside the bottle in order to sustain the nipple in the upwards position so the infant can drink milk continuously.

Various details of the invention may be changed without departing from its scope. Furthermore, the foregoing description of the preferred embodiments of the invention and the best mode for practicing the invention are provided for the purpose of illustration only and not for the purpose of limitation since the invention is defined by the claims.

What is claimed is:

1. A straw set with a ventilating structure comprising:

a nipple having a sucking part and a drawing hole, and being connected to a circular base consisting: a first circular air guiding trench on the surface of said circular base, a first air hole passing through said circular base, and a chamber with two expanding axles on the bottom of said circular base;

a straw base consisting: an inner circular wall to support said nipple, a first outer circular wall to attach to the bottom of said circular base, a second circular air guiding trench concaved between said inner circular wall and said first outer circular wall, and a hollow pipe protruding downwards from said straw base;

a soft plastic circular base to support said straw base, consisting: a hole that passes through the center of said soft plastic circular base, a second outer circular wall protruding upwards from the edge of said soft plastic circular base to fix upon said first outer circular wall of said straw base, an air guiding trench expanding from the edge of said second outer circular wall down to said soft plastic circular base, a second air hole located at the bottom side of said air guiding trench and passing through said soft plastic circular base; and a soft straw comprising a head to encircle said hollow pipe of said straw base.

* * * * *